US010278420B2

(12) United States Patent
Spurling, III

(10) Patent No.: US 10,278,420 B2
(45) Date of Patent: May 7, 2019

(54) BIDIRECTIONAL CIGAR SPLITTER

(71) Applicant: George A. Spurling, III, Orlando, FL (US)

(72) Inventor: George A. Spurling, III, Orlando, FL (US)

( * ) Notice: Subject to any disclaimer, the term of this patent is extended or adjusted under 35 U.S.C. 154(b) by 372 days.

(21) Appl. No.: 15/298,566

(22) Filed: Oct. 20, 2016

(65) Prior Publication Data

US 2017/0035106 A1 Feb. 9, 2017

Related U.S. Application Data

(63) Continuation-in-part of application No. 14/490,753, filed on Sep. 19, 2014, which is a continuation-in-part of application No. 13/833,472, filed on Mar. 15, 2013, now Pat. No. 9,486,012, application No. 13/833,472, filed on Mar. 15, 2013, now Pat. No. 9,486,012, which is a continuation-in-part of application No. PCT/US2011/001671, filed on Sep. 29, 2011, and a continuation-in-part of application No. 13/052,628, filed on Mar. 21, 2011, now abandoned.

(51) Int. Cl.

| | |
|---|---|
| ***A24F 13/24*** | (2006.01) |
| ***A24F 13/26*** | (2006.01) |
| ***F23Q 2/32*** | (2006.01) |

(52) U.S. Cl.
CPC ..... *A24F 13/26* (2013.01); *A24F 13/24* (2013.01); *F23Q 2/32* (2013.01)

(58) Field of Classification Search
None
See application file for complete search history.

(56) References Cited

U.S. PATENT DOCUMENTS

2010/0065074 A1* 3/2010 Lee ..... A44B 15/00 131/253

* cited by examiner

*Primary Examiner* — Michael J Felton
(74) *Attorney, Agent, or Firm* — Stephen C. Thomas

(57) ABSTRACT

An improved size adaptable cigar splitting apparatus comprising and outer body and an inner size adapting sleeve adapted to be slidingly engaged therewith and further comprising a cutting blade for splitting the wrapper and, if present, packaging of a cigar, cigarillo or other smoking device. In a preferred embodiment, the inner size adapting sleeve may be cylindrical in shape and is removable, allowing the invention to be adapted to various sizes of smoking devices. The cigar splitter apparatus of the invention is adapted to receive smoking devices of various diameters which include all common diameters of smoking devices currently in use. The cutting blade is adapted to be removable and replaceable. The improved size adaptable cigar splitter apparatus of the invention may further comprise a lanyard tang adapted to receive a necklace, lanyard, or similar structure to facilitate ease of carrying.

17 Claims, 8 Drawing Sheets

BIDIRECTIONAL CIGAR SPLITTER

CROSS REFERENCE TO RELATED APPLICATIONS AND INCORPORATION BY REFERENCE

This application claims priority to and is a Continuation-In-Part (CIP) of prior-filed U.S. non-provisional application Ser. No. 13/833,472, filed in the United States Patent and Trademark Office on Mar. 15, 2013 which is herein incorporated by reference in its entirety, which was a Continuation-In-Part of prior-filed U.S. non-provisional application Ser. No. 13/052,628, filed in the United States Patent and Trademark Office on Mar. 21, 2011 which is herein incorporated by reference in its entirety; application Ser. No. 13/833,472 was also a Continuation-In-Part of prior filed international application PCT/US11/01671 filed in the United States Receiving Office (USRO) on Sep. 29, 2011, which is also herein incorporated by reference in its entirety; this application also claims the benefit of, and is a Continuation-In-Part of, U.S. utility application Ser. No. 14/490,753, filed with the United States Patent and Trademark Office on Sep. 19, 2014, which is herein incorporated by reference in its entirety and which was a Continuation-In-Part of prior-filed U.S. non-provisional application Ser. No. 13/833,472, filed in the United States Patent and Trademark Office on Mar. 15, 2013, which is herein incorporated by reference in its entirety, and application Ser. No. 14/490,753 was also a Continuation-In-Part of prior filed international application PCT/US11/01671 filed in the United States Receiving Office (USRO) on Sep. 29, 2011, which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The improved size adaptable cigar splitting apparatus of the invention relates to cigar accessories such as a cigar splitter that may be used to safely and precisely multi-purpose split the packaging and wrapper of a smoking device such as a cigar, cigarillo or similar product along the length of its axis, allowing user to empty the wrapper of its original contents, for instance, tobacco, whereupon a user by then re-fill the wrapper with a preferred smoking substance, for instance, a preferred brand or tobacco, a flavor enhancer or some other desired smoking substance. The improved size adaptable cigar splitting apparatus of the invention is adaptable to various sizes of smoking device through the use of a removable size-adapting sleeve. The cutting blade of the invention is removable and replaceable by means of a carrier that is slidingly engaged with a receiving channel disposed within the outer body of the invention. The invention is adapted to receive smoking devices of various outer dimensions by means of a size adapting sleeve.

2. Background Art

Cigar smoking has become a popular past time during in recent years. As cigar smoking has gained in popularity, so too have the accessories utilized to cut and light cigars, cigarillos and like smoking devices. The proper tools for cutting and lighting cigars are perceived to enhance the cigar smoking experience. For example, many experienced cigar smokers will leave the head portion of the cigar in its finished, pre-smoked state until the cigar is ready to be smoked, in order to preserve and maximize the flavor and freshness of the cigar. Before smoking, the experienced cigar smoker may cut the finished head portion (i.e. the smoking end of the cigar which is placed in the user's mouth) of the cigar with a tool to provide a clean cut. It is well known in the art of cigar cutters to provide a guillotine style cutter which is used to clip the smoking end of the cigar. It is also known to provide a tubular cutter, or punch cutter, for forming a hole or opening in the smoking end of the cigar. Both types of cutters are well known in the art, as are v-shaped cutters, all of which provide a clean cut to ensure proper circulation through the body of the cigar when smoked.

As is commonly the case, a split along the length of a wrapper of a cigar, cigarillo or other smoking device may be desired by the user in certain situations. For various reasons, such as the insertion of flavor enhancers, easier draw, or the like, such length-wise splits in the wrapper of the smoking device are often highly desirable. However, few smokers have access to a proper tool for safely and accurately making such length-wise splits. Often pocket knives or razors are used, an obviously dangerous practice. Further, it is generally accepted that the splits should be precisely made such that the length of the cigar or cigarillo wrapper is not distorted or unnecessarily damaged. A sloppy split can easily result in an un-smokable cigar or cigarillo. Further, the wrapper on the cigar or cigarillo may be an important flavor enhancer, and may also provide an ascetic feature. A poorly made split or a poorly made splitting tool can easily ruin the wrapper of a cigar or cigarillo. With the cost of a good cigar or cigarillo often at a premium, this is an important consideration as to whether to risk ruining an expensive smoking device. The present apparatus provides a splitter that is precise, safe to both user and cigar, and compact, thus eliminating the risk associated with wrapper splitting using the familiar hand-controlled means, such as a pocket knife.

As used herein, the term "wrapper" is used to identify the outer casing or shell of a cigar which is intended generally to be smoked along with tobacco encased by the wrapper. In use, the wrapper may often be fabricated from a tobacco leaf that may be different in nature than the tobacco that forms the innermost part of the cigar. The wrapper typically is used to hold the cigar together and is typically closed on both ends in order preserve freshness until the cigar is to be used. A cigar's wrapper typically comes from the widest part of the tobacco plant. When smoked, the wrapper may determine much of the cigar's character and flavor, and as such its color is often used to describe the cigar as a whole. Over 100 wrapper shades are identified by manufacturers. As used herein, the term "packaging" refers to the plastic, paper or other package that may be used to encase a cigar for shipment and display. The packaging is typically removed before smoking. Also, while the discussion of this paragraph is directed to cigars, it is to be understood that the definitions provided herein also apply to cigarillos and other smoking devices.

BRIEF SUMMARY OF THE INVENTION

The present invention comprises an apparatus or device that has one or more of the following features, which either alone or in any combination may comprise patentable subject matter.

This invention generally relates to a novel device comprising at least one blade for splitting cigar wrappers which is adaptable to various sizes of cigars, cigarillos, and other smoking devices through the use of a removable size adapting sleeve. The improved size adaptable cigar splitting apparatus of the invention may also be used to slice through the packaging of the cigar while at the same time splitting the cigar wrapper, resulting in a savings of time and effort to the user. In a preferred embodiment, a single blade is used to perform the splitting function. The improved size adaptable cigar splitting apparatus of the invention may be fabricated from any material suitable to reliably maintain its dimension and shape in ordinary use, for example, the improve cigar splitting device of the invention may be fabricated from wood, metal, plastic, phenolic or any other similar material.

The improved size adaptable cigar splitting apparatus of the invention is able to be manufactured with dimensions slightly larger than the outer diameter of a typical smoking device, such as for example a cigar, and is therefore small and may be lightweight enough such that it can be carried in a pocket for ease-of-use. The cutting blade of the invention is removable and replaceable by means of a carrier that is slidingly engaged with a receiving channel disposed within the outer body of the invention. Furthermore, embodiments of the improve cigar splitting device of the invention comprises a lanyard tang and lanyard attachment through hole which may be used to retain the improve cigar splitting device of the invention on a keychain, lanyard, necklace, string, or similar structure. Thus, the lanyard attachment feature of the improved size adaptable cigar splitting apparatus of the invention provides a feature enabling a user to reliably carry the invention in a variety of manners as the user desires.

In further alternate embodiments of the improved size adaptable cigar splitting apparatus of the invention, multiple blades may be used.

One aspect of the present invention is to provide a housing comprising a hollow cylinder and a blade disposed in the center along the length of the cylinder, such that when a user inserts a cigar, cigarillo, or other smoking device into the hollow cylinder and translates the smoking device longitudinally through the cylinder, the smoking device wrapper, and, if present, packaging, is split lengthwise thus allowing the user to remove the original contents of the smoking device and, if desired, replace the original contents of the smoking device with a preferred smoking substance such as, for instance, a premium tobacco or other smoking substance.

A further aspect of the present invention is that the cigar splitting blade comprises a cutting edge of oriented in a plane that contains the long axis of an outer housing, for cutting the wrapper of a cigar or cigarillo of a first diameter as the cigar or cigarillo is inserted through one end of the first housing and out the other end. Still further, an inner size adapting sleeve is provided which is adapted to accept a cigar or cigarillo of a second, smaller diameter, wherein the inner size adapting sleeve is further adapted to be received by the outer housing in such a fashion as to enable the cigar splitting blade to split the wrapper of a smoking device having a diameter roughly equivalent to the second, smaller diameter of the inner size adapting sleeve. In this manner, a primary aspect of the present invention is to split a cigar, cigarillo or other smoking device, which may be of varying diameter, along a chosen length of its axis.

Still another aspect of the present invention is to provide an apparatus that is safe to use for both cigar and user alike.

Yet still another aspect of the present invention is to provide an apparatus that is safe when stored.

These together with additional aspects, features, and advantages of the improved size adaptable cigar splitting apparatus of the invention will be readily apparent to those of ordinary skill in the art upon reading the following detailed description of presently preferred, but nonetheless illustrative, embodiments of the improved size adaptable cigar splitting apparatus when taken in conjunction with the accompanying drawings.

In this respect, before explaining the various embodiments of the improved size adaptable cigar splitting apparatus of the invention in detail, it is to be understood that the improved size adaptable cigar splitting apparatus of the invention is not limited in its application to the details of construction and arrangements of the components set forth in the following description or illustration, as there are many equivalent structures all of which are included within the scope and claims of the invention. Those skilled in the art will appreciate that the concept of this disclosure may be readily utilized as a basis for the design of other structures, methods, and systems for carrying out the several purposes of the improved size adaptable cigar splitting apparatus. It is therefore important that the claims be regarded as including such equivalent constructions insofar as they do not depart from the spirit and scope of the improved size adaptable cigar splitting apparatus of the invention. It is also to be understood that the phraseology and terminology employed herein are for purposes of description and should not be regarded as limiting.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

Figure 1:
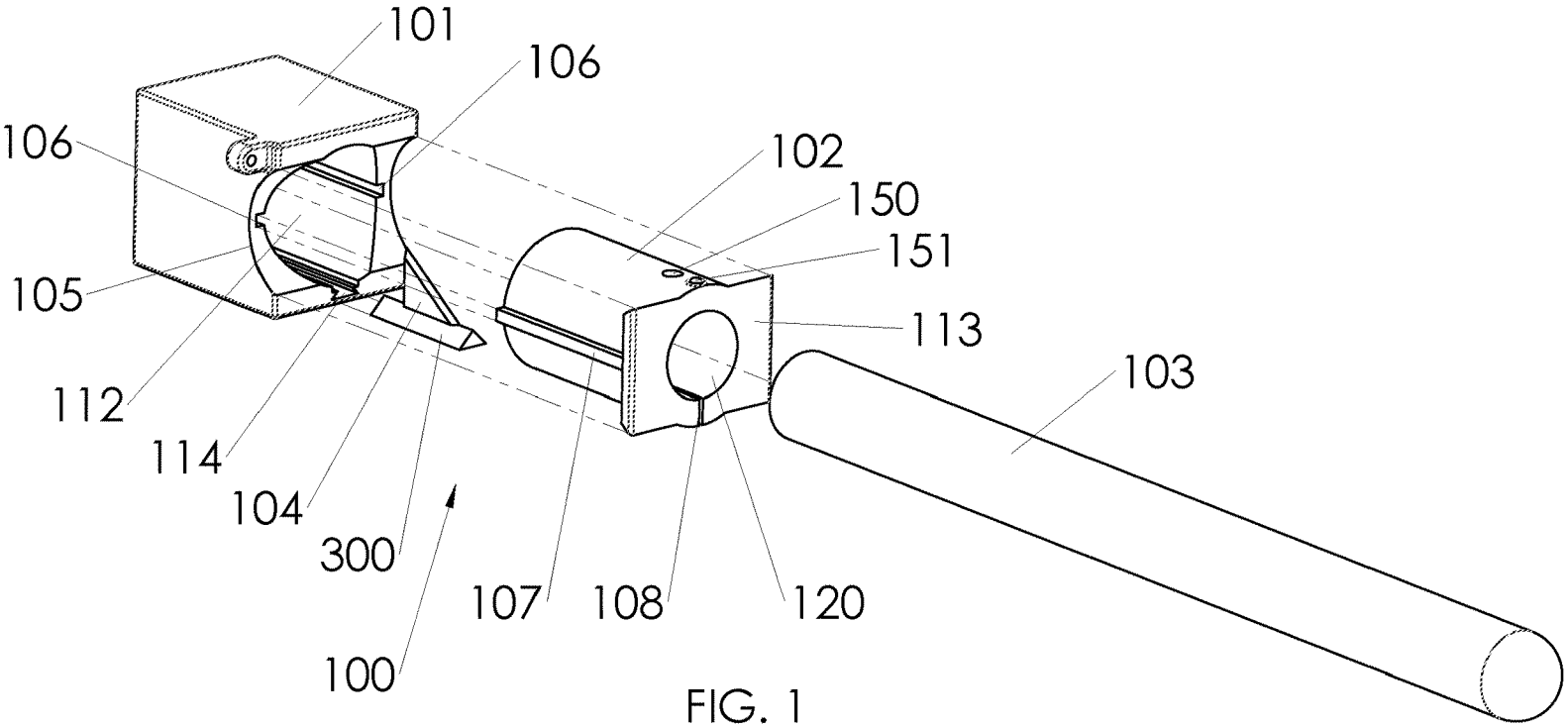
FIG. 1 depicts a perspective view of a preferred embodiment of the invention as it is used with a smoking device, such as a cigar.

Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

Tobacco companies make numerous types of cigars in terms of size, type, and flavor. However, all flavors are typically not available in all types or sizes. The apparatus of the present invention helps cut open a cigar wrapper so that a customer of a cigar company may smoke any flavor out of any type or size of cigar that he or she desires. The present inventive apparatus provides a smoker of cigars with a compact, precise tool for splitting a cigar along its axis. Furthermore, the cutter does not extend beyond the boundary of the apparatus so that it is safe to use.

As mentioned above, some users of cigars and other products for smoking find it advantageous and enjoyable to substitute the usual tobacco filling in pre-made cigars with another style of tobacco or with another smoking substance altogether, and to smoke the newly-filled cigar with the substituted filling. The present invention addresses this need by providing an apparatus for splitting cigar wrappers.

As used herein, "sliding surface" means the outer surfaces of inner size adapting sleeve 102 and inner size adapting sleeve interior opening 112 that are adapted to slidingly engage as described below and depicted in the drawings.

Referring now to FIG. 1, a preferred embodiment of the invention is shown in perspective view. Also shown in the figure is a smoking device 103 which may be a cigar, cigarillo, or any other smoking device. The embodiment of the improved size adaptable cigar splitting apparatus of the invention 100 depicted in FIG. 1 comprises outer housing 101, inner size adapting sleeve 102 and a blade carrier 300 which are discussed in more detail below.

Still referring to FIG. 1, outer housing 101 comprises an opening 112 having an interior surface for receiving either a smoking device 103 or size adapting sleeve 102, a channel 114 adapted to receive blade carrier 300 in a sliding engagement, which may be a slight press fit engagement such that the cigar splitter may be used for splitting wrappers with or without size adapting sleeve 102, and may comprise one or more outer housing receiving slots 106. The sliding engagement between blade carrier 300 and outer body channel 114 may be provided by complementary surfaces in channel 114 and blade carrier 300. In the embodiment depicted in FIG. 1, the complementary surfaces are triangular in cross section, but this embodiment is exemplary only, and thus the complementary surfaces may take any cross sectional shape. In the embodiment of the invention shown in FIG. 1, there are two outer housing receiving slots 106 set in a substantially diametrically opposed position. Alternate embodiments of the invention may incorporate one or a plurality of outer housing receiving slots 106. It can be seen from the perspective view of the invention depicted in FIG. 1 that outer body interior surface 112 may be, in this preferred embodiment, substantially cylindrical in shape and is adapted to slidingly receive the body of inner size adapting sleeve 102, which, in the preferred embodiment shown in FIG. 1, is also cylindrical in shape. It is noted that although the embodiment depicted in FIG. 1 utilizes a cylindrical shape for inner size adapting receiving channel 112 and the body of size adapting sleeve 102, a cylindrical shape is only one of any number of shapes which may be utilized. For instance, the shape of inner size adapting receiving channel 112 in the body of inner size adapting sleeve may be elliptical cross-section, rectangular in cross-section, square in cross-section or any other cross-sectional shape which allows inner size adapting sleeve 102 to freely slide into inner size adapting sleeve receiving channel 112 with a substantially snug fit.

The outer surface of size adapting sleeve 102 may be slidingly engaged with the interior surface of outer body opening 112. Size adapting sleeve 102 comprises an orifice 120 passing through size adapting sleeve 102 for accepting smoking devices 103, and is usable to adapt the invention to accept smoking devices of smaller outside dimension than the interior surface of outer body opening 112. Thus, when it is desired to utilize the invention 100 with a smoking device 103 that is characterized by an outer dimension that is too small to reliably split the smoking device wrapper by passing the smoking device 103 through outer body opening 112, size adapting sleeve 102 may be slidingly engaged with outer body opening 112, and the smoking device may be passed through orifice 120.

The improved size adaptable cigar splitting device of the invention 100 may further comprise features to prevent the rotation of inner size adapting sleeve 102 within the inner size adapting sleeve receiving channel 112 of outer housing 101. One embodiment of such features is shown in FIG. 1 as outer housing receiving slots 106 which are adapted to be slidingly engaged with inner size adapting sleeve rail 107. It can be seen from FIG. 1 that when inner size adapting sleeve 102 is slidingly engaged into outer housing 101, inner size adapting sleeve rails 107 are slidingly engaged with and received by outer housing receiving slots 106. With the inner size adapting sleeve rails 107 thus slidingly engaged and received by outer housing receiving slots 106, inner size adapting sleeve 102 is prevented from rotating as it slides into and is retained within inner size adapting sleeve receiving channel 112 of outer housing 101.

Still referring to FIG. 1, splitting or cutting blade 104 may be mounted or attached to blade carrier 300. Blade 104 may be attached to blade carrier 300 by any means known in the art. In the embodiment depicted in FIG. 1, blade 104, which may have an angled cutting edge oriented towards inner size adapting sleeve 102 as inner size adapting sleeve 102 slides into and is received by inner size adapting sleeve receiving channel 112, is affixed to blade carrier 300 by being pressed into a slot in blade carrier 300 which is designed for that purpose. Thus, blade 104 may be retained in blade carrier 300 using a press fit or, in some embodiments, may be secured its place using adhesives, chemical bonding or any other means known in the art for attaching such structures. Still further, as inner size adapting sleeve 102 slides into outer housing 101, blade 104 passes through blade clearance slot 108 in inner size adapting sleeve 102 without substantial interference. Blade 104 may be of sufficient dimension to protrude through slot 108 into the receiving orifice 120 of size adapting sleeve 102 when said size adapting sleeve 102 is slidingly engaged with said interior surface of opening 112 of said outer body, as is further depicted in FIG. 2.

Figure 2:
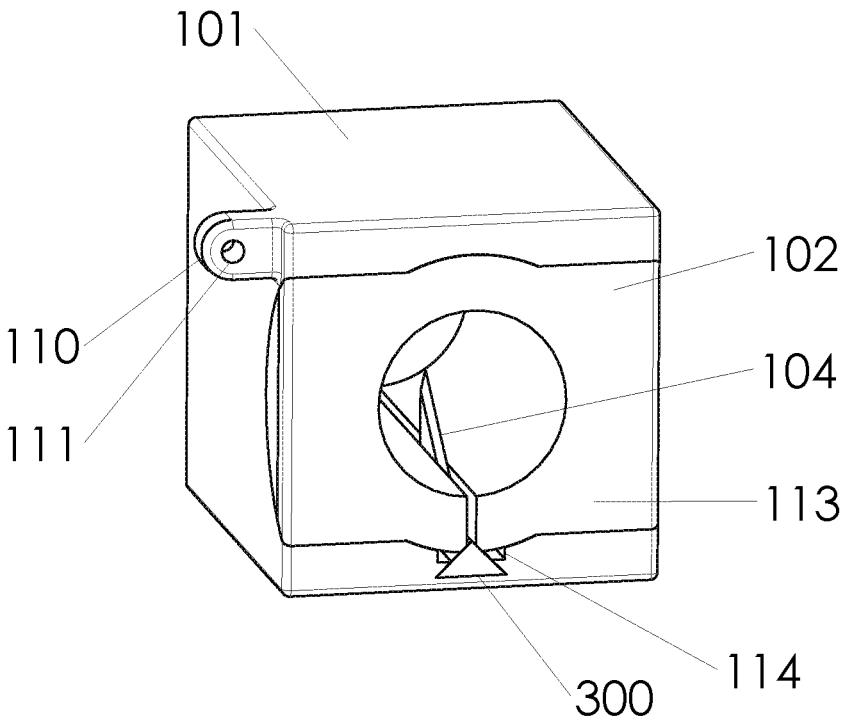
FIG. 2 depicts a perspective view of a preferred embodiment of the invention.

Still referring to FIG. 1, magnet 150 may be retained in any sliding surface of inner size adapting sleeve 102 but is preferably located on a top surface of inner size adapting sleeve 102 as shown in the drawing. Further, a magnet of opposite polarity 152 (not shown in FIG. 1), or a ferrous metal tab 153 (not shown in FIG. 1), may be disposed on a sliding surface of inner size adapting sleeve receiving channel 112, located so as to be in near enough proximity to magnet 150 when inner size adapting sleeve 102 is fully slidingly engaged as depicted in FIG. 2 such that magnet 150 retains inner size adapting sleeve 102 in place by operation of the magnetic attraction between magnet of opposite polarity 152, or ferrous metal tab 153 and magnet 150.

Still referring to FIG. 1, retaining protrusion 151 may be present on any sliding surface of inner size adapting sleeve 102 but is preferably located on a top surface of inner size adapting sleeve 102 as shown in the drawing. Retaining protrusion 151 protrudes slightly from the sliding surface and provides a press fit with the receiving sliding surface of inner size adapting sleeve receiving channel 112 as inner size adapting sleeve 102 is slidingly engaged with inner size adapting sleeve receiving channel 112. This press fit acts to retain retains inner size adapting sleeve 102 in place when inner size adapting sleeve 102 is slidingly engaged with inner size adapting sleeve receiving channel 112.

Still referring to FIG. 1, it can be seen that a cigar, cigarillo or any other smoking device 103 may be translated through inner size adapting sleeve receiving orifice 120 such that it's wrapper, and also its packaging if present, will be cut by splitting blade 104 as it passes through inner size adapting sleeve receiving orifice 120 and exits the far side of the improved size adaptable cigar splitting device of the invention. After smoking device 103 has passed through the improved size adaptable cigar splitting device of the invention, any packaging may be discarded and the smoking device wrapper may be emptied of its original contents and refilled with any smokable content desired by the user. The user will then be in possession of a smoking device which utilizes the original wrapper but is filled with new content, which may be, for example, a new or different style or flavor of tobacco or any other smoking substance the user desires.

Still referring to FIG. 1, it can also be seen that for a full-size cigar smoking devices of larger diameter, is not necessary to utilize inner size adapting sleeve 102 when using the invention. Thus, for larger smoking devices, inner size adapting sleeve 102 is not used, and the larger smoking device 103 is passed through the inner size adapting sleeve receiving channel 112 of outer housing 101, where splitting blade 104 cuts the wrapper of smoking device 103 and also its packaging, if present.

Blade 104 may be of such dimension that the blade cutting edge protrudes into inner size adapting sleeve receiving orifice 120 far enough such that it will cut the wrapper and packaging of a smoking device 103 that is passed through inner size adapting sleeve receiving orifice 120. Thus, splitting blade 104 may protrude into inner size adapting sleeve receiving orifice 120 by a dimension that is equal to or greater than the combination of the thickness of a cigar wrapper and the thickness of cigar packaging. In a preferred embodiment the protrusion of splitting blade 104 into inner size adapting sleeve receiving orifice may be on the order of at least 0.090 inches to 0.250 inches, however, alternate embodiments of the improved size adaptable cigar splitting device of the invention may comprise different protrusions.

It should also be noted that outer body 101 may be used without inner size adapting sleeve 102 for splitting smoking devices of appropriate outer dimension. Inner size adapting sleeve face flange 113 and face flange receiving recess 105 enables a preferred embodiment of the improved size adaptable cigar splitting device of the invention to take the shape of a solid when inner size adapting sleeve 102 is completely slidingly engaged with inner size adapting sleeve receiving channel 112 of our outer housing 101.

Referring now to FIG. 2, a perspective view of the improved size adapting cigar splitting apparatus of the invention is shown. It can clearly be seen that the leading cutting-edge of splitting blade 104 preferably, but not necessarily, faces the direction from which inner size adapting sleeve 102 slides into outer housing 101. Also clearly shown in FIG. 2 is lanyard tang 110 and lanyard attachment hole 111, which may be incorporated into a preferred embodiment of the invention. The purpose of lanyard tang 100 and lanyard attachment hole 111 is to enable the improved size adaptable cigar splitting apparatus of the invention to be retained upon a lanyard or similar structure such as a necklace, bracelet, string, chain or similar structure for ease of carrying and to prevent loss. In this manner, for instance, the improved size adaptable cigar splitting apparatus of the invention may be worn as a necklace where it may be kept handy for immediate use. Also shown in FIG. 2 inner size adapting sleeve face flange 113, which may, in a preferred embodiment, mate with and be received by face flange receiving recess 105 which may be a feature of outer housing 101. Inner size adapting sleeve face flange 113 and face flange receiving recess 105 enables a preferred embodiment of the improved size adaptable cigar splitting device of the invention to take the shape of a smooth solid when inner size adapting sleeve 102 is completely slidingly engaged with inner size adapting sleeve receiving channel 112 of outer housing 101. Such smooth appearance may be desirable for aesthetic reasons. Alternate embodiments of the improved size adaptable cigar splitting apparatus of the invention may incorporate face flanges 113 of different shape other than that shown in the figures. Blade retaining slot 114 is also shown in FIG. 2.

Figure 3:
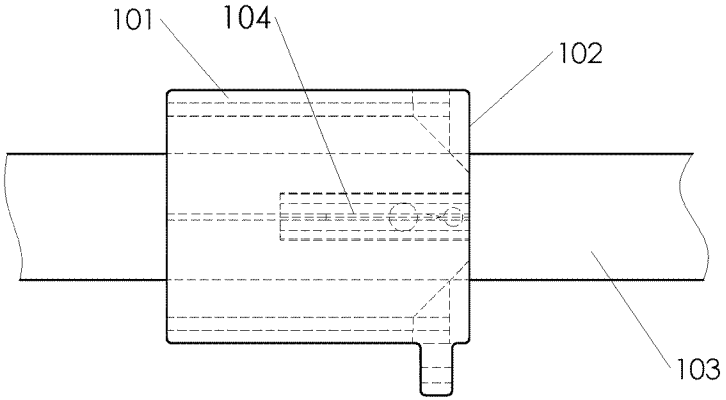
FIG. 3 depicts a side view of a preferred embodiment of the invention in use with a cigar.

Referring now to FIG. 3, a top view of a preferred embodiment of the improved size adaptable cigar splitting apparatus of the invention is shown wherein inner size adapting sleeve 102 is completely slidingly engaged with inner size adapting sleeve receiving channel 112 of outer housing 101. A smoking device 103, which may be, for example, a cigarillo, slides through inner size adapting sleeve receiving orifice 120 such that the wrapper, and packaging if present, are cut by splitting blade 104.

Figure 4:
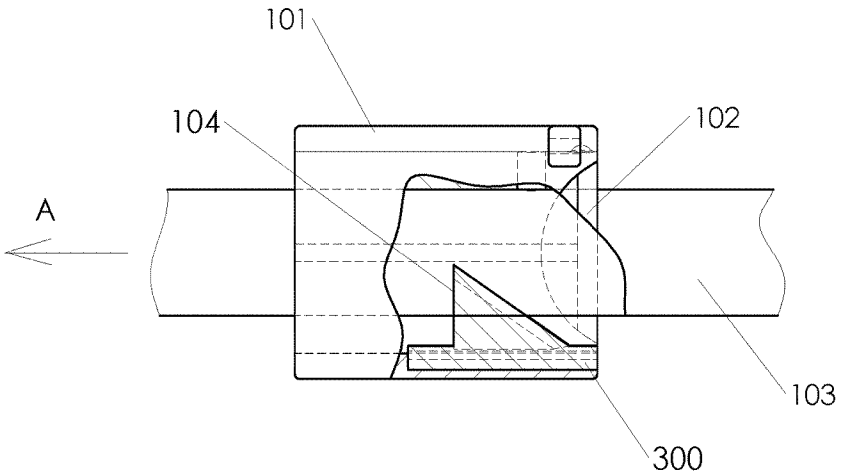
FIG. 4 depicts a cutaway side view of a preferred embodiment of the invention in use with a cigar.

Referring now to FIG. 4, a side view of a preferred embodiment of the improved size adaptable cigar splitting apparatus of the invention is shown in a view rotated 90° from FIG. 3, and where splitting blade 104 is shown in a cutaway view, and wherein inner size adapting sleeve 102 is completely slidingly engaged with inner size adapting sleeve receiving channel 112 of outer housing 101. It can be seen that smoking device 103 slides through the inner size adapting sleeve receiving orifice 120 of inner size adapting sleeve 102 in the direction shown by arrow A. When smoking device 103 moves in the direction indicated by arrow A, it can be seen that the leading cutting-edge of splitting blade 104 serves to cut the wrapper, and packaging if present, a smoking device 103, which is an intended function of the improved size adapting cigar splitting apparatus of the invention.

Figure 5:
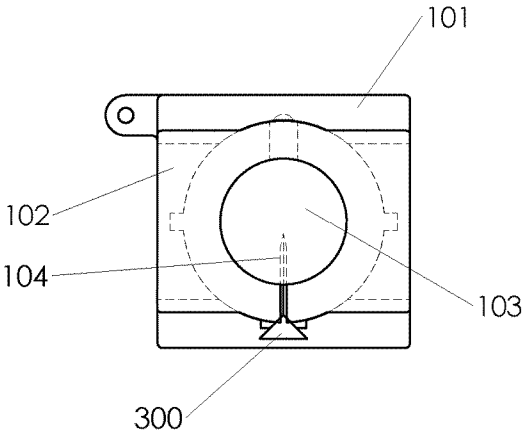
FIG. 5 depicts an end view of a preferred embodiment of the invention.

Referring now to FIG. 5 a view of a preferred embodiment of the improved size adaptable cigar splitting apparatus of the invention is shown wherein inner size adapting sleeve 102 is completely slidingly engaged with inner size adapting sleeve receiving channel 112 of outer housing 101. In this preferred embodiment, is clearly seen that splitting blade 104 protrudes into inner size adapting sleeve receiving orifice 120.

Figure 6:
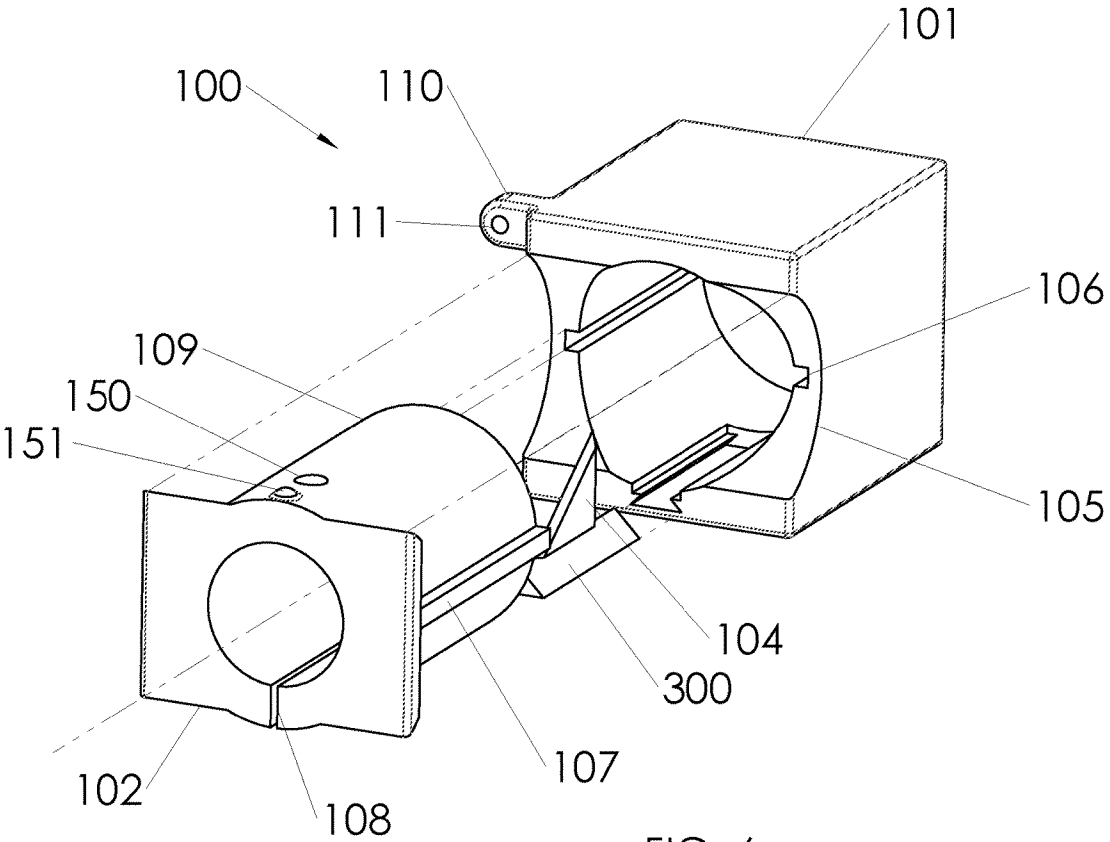
FIG. 6 depicts a perspective view of a preferred embodiment of the invention and further shows inner size adapting sleeve sliding into the outer housing of the invention.
Figure 7A:
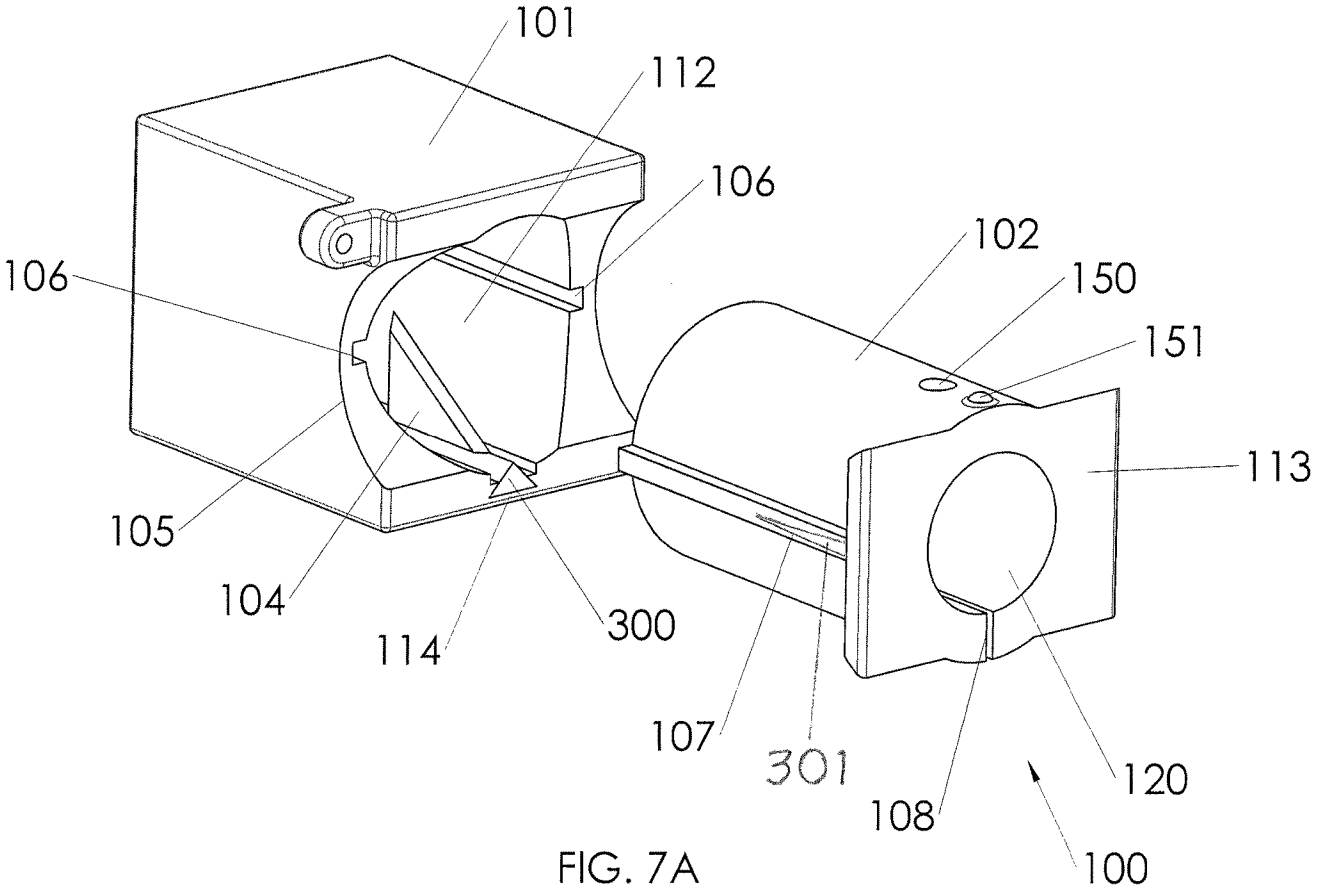
FIGS. 7A and 7B depict a perspective views of an alternate embodiments of the invention.

Referring now to FIGS. 6 and 7A, an additional perspective view of the improved size adaptable cigar splitting apparatus of the invention is provided in which it can clearly be seen that inner size adapting sleeve rail 107 is slidingly engaged with and received by outer housing receiving slot 106 as inner size adapting sleeve 102 slides into outer housing 101. Cutting blade 104, which is, as hereinbefore mentioned attached to blade carrier 300, slides through blade clearance slot 108 in inner size adapting sleeve 102. Blade clearance slot 108 is adapted and dimensioned to allow cutting blade 104 to pass without substantial interference, enabling inner-size adapting sleeve 102 to slide into outer housing 101 without catching or otherwise substantially interfering with splitting blade 104. Also clearly shown in FIG. 6 is lanyard tang 110 and lanyard attachment hole 111, which may be incorporated into any embodiment of the invention. Optional magnet 150 and optional retaining protrusion 151 are also depicted. Face flange receiving recess 105 is depicted for reference. A tapered, raised rib 301 may be included on size adapting sleeve rail 107, creating a progressively secure press fit between inner size adapting sleeve 102 within outer housing 101 as inner size adapting sleeve 102 slides into inner size adapting sleeve receiving channel 112.

It should be noted, and is herein stated, that inner size adapting sleeve receiving channel 112 is of such dimension to receive cigars of typical size and shape, and likewise inner size adapting sleeve receiving orifice 120 is of such dimension to receive cigarillos of typical size and shape.

Figure 7B:
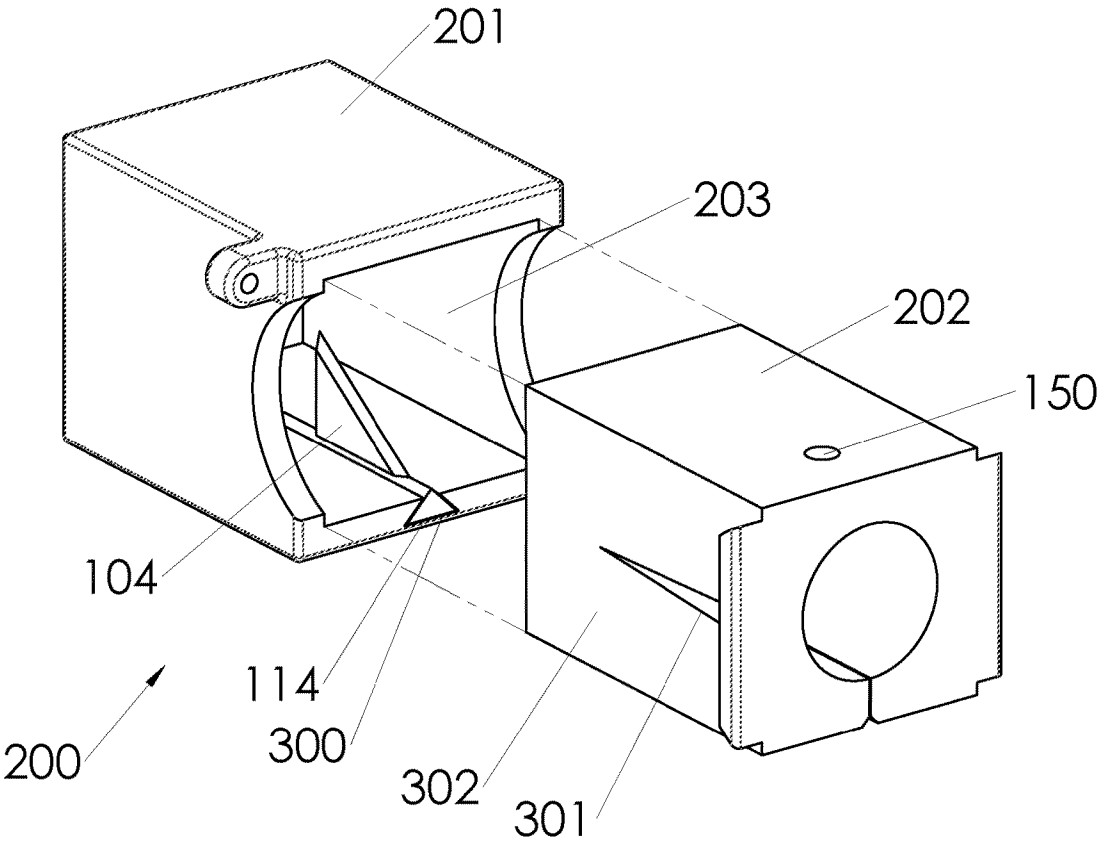

Referring now to FIG. 7B, an alternative embodiment 300 of the improved size adaptable cigar splitting apparatus of the invention is depicted in which inner size adapting sleeve 202 is not of cylindrical shape but is rather rectilinear in shape and maybe rectangular or square in cross-section. Likewise, inner size adapting sleeve receiving channel is of similar cross-sectional shape such that it is adapted to receive inner size adapting sleeve 202 with a substantially sliding engagement, which allows inner size adapting sleeve 202 to slide into outer housing 201. In this alternate embodiment, outer housing receiving slot 106 and inner size adapting sleeve rail 107 are not included, as such features are necessary due to the fact that the rectilinear cross-section of inner size adapting sleeve 202 as received by rectilinearly shaped inner size adapting sleeve receiving channel 203 that prevents rotation of inner size adapting sleeve 202 within outer housing 201. It can thus be seen that the cross-sectional shape of the inner size adapting sleeve and inner size adapting sleeve receiving channel may be essentially any shape which allows the inner size adapting sleeve to be received by the inner size adapting sleeve receiving channel with a sliding engagement. Blade 104 is shown pressed or bonded into place. A tapered, raised rib 301 may be included on face 302, creating a progressively secure press fit between inner size adapting sleeve 202 within outer housing 201 as inner size adapting sleeve 202 slides into inner size adapting sleeve receiving channel 203.

Figure 8:
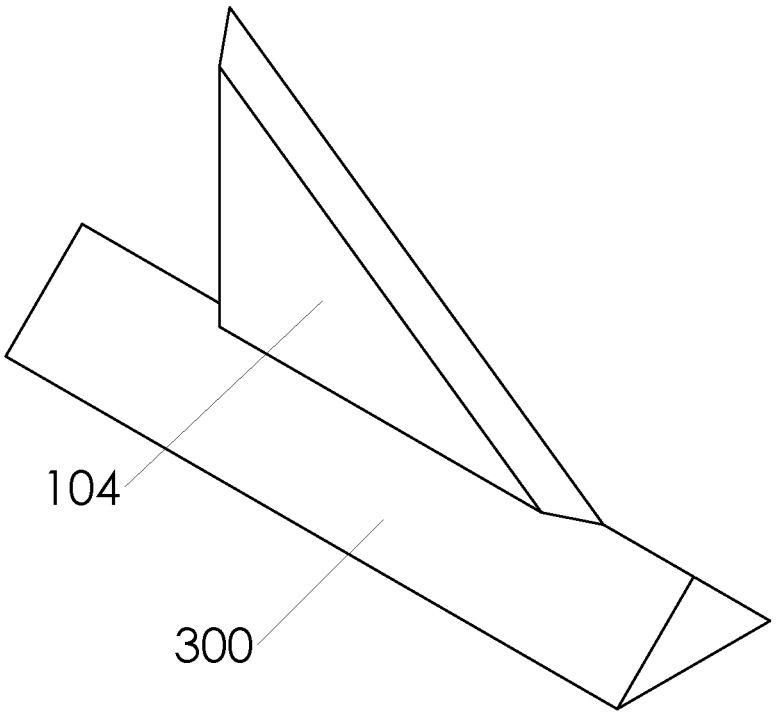
FIG. 8 depicts a perspective view of an alternate arcuate embodiment of the blade carrier of the invention.

Referring now to FIG. 8, a perspective view of an embodiment of the blade carrier 200 of the invention is depicted. Blade 104 is attached to carrier 300 as hereinbefore described. In this embodiment, the cross section of the complementary surface of carrier 300 is triangular in cross section; however, the invention may comprise other cross sectional shapes for the complementary surfaces of blade carrier 300.

Figure 9:
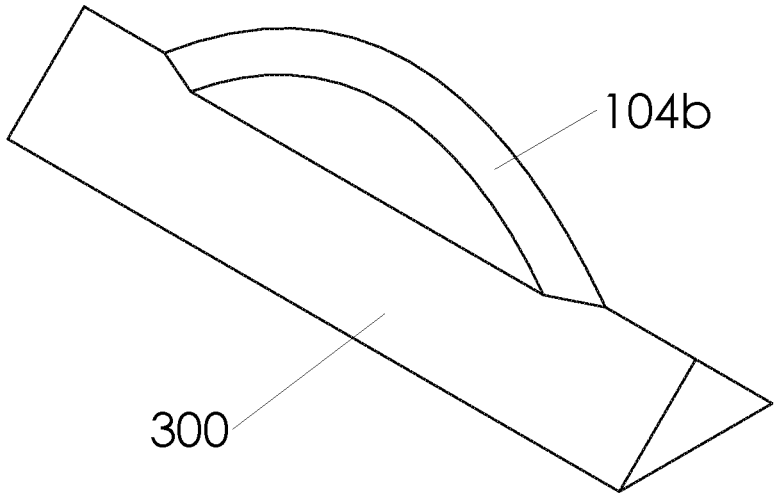
FIG. 9 depicts a perspective view of an embodiment of the blade carrier of the invention in which the blade comprises a half-moon shape for bidirectional cigar wrapper splitting.
Figure 10:
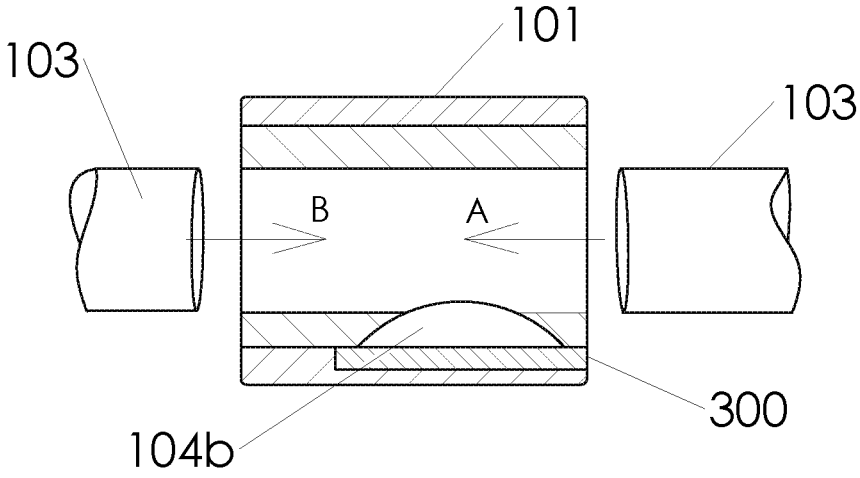
FIG. 10 depicts a cross sectional view of the invention utilizing an alternate arcuate embodiment of the blade carrier of the invention.

Referring now to FIGS. 9 and 10, a perspective view and a cross section view of an alternate embodiment of a blade carrier 300 of the invention, respectively, are depicted, in which the invention may be utilized bidirectionally. In in this embodiment, the cutting edge of blade **104*b* comprises an arcuate shape, or half-moon shape, such that a smoking device may be passed through either outer body opening 112 or size adapting sleeve orifice 120 in either direction A or B. Thus, in this embodiment of the invention, the smoking device 103 may pass through the invention for cutting the wrapper from either direction due to the arcuate shape of blade 104*b*. Outer body 101 is called out for reference. The embodiment of blade 104*b* depicted in FIGS. 9 and 10** may be utilized in any embodiment of the invention.

From the foregoing discussion and the figures, it is to be appreciated that the invention's use of an inner size adapting sleeve which is designed to be slidingly received by an outer housing enables the improved size adaptable cigar splitting device of the invention to be used in conjunction with cigars, cigarillos, and other smoking devices of various outer dimension, thus making it a useful and adaptable apparatus for splitting the wrapper, and if present, packaging, of a cigar, cigarillo, or other smoking device. While specific sizes are not essential to the scope of the present invention, a preferred embodiment of the improved size adaptable cigar splitting apparatus of the invention may comprise a inner size adapting sleeve receiving channel 112 sized for splitting cigars, cigarillos, and the like having approximately one-half (½) inch diameters and an inner size-adapting sleeve 102 comprising an inner size adapting sleeve receiving orifice 120 sized for splitting cigars, cigarillos, and the like having approximately one-quarter (¼) inch diameters. Cigars and cigarillos may typically have diameters expressed as a ring gauge measurement with typical sizes including but not limited to those within the ring gauge range of 18 to 80. The scope of the present invention includes all known diameters or ring gauges.

It should also be noted that the described embodiments as depicted in the figures and as described in the specification comprise typical, exemplary embodiments of the invention. The scope and breadth of the claims cover not only those embodiments shown in the figures and described in the specification, but they cover all equivalent structures as well.

Use of the apparatus of the present invention makes changing the flavor or smoking contents of a cigar quick and easy. The present invention provides the convenience of two or more separate instruments in one.

INDUSTRIAL APPLICABILITY

The present invention provides an improved size adaptable cigar splitting apparatus. In a preferred embodiment, the cigar splitter may comprise an outer body and an inner size adapting sleeve which is used to adapt the improved size adaptable cigar splitting apparatus of the invention various sizes of cigars, cigarillos, and other smoking devices. The improved size adaptable cigar splitting apparatus of the invention may further comprise a lanyard tang and attachment hole that may be adapted to receive a chain such as is worn in a necklace, a lanyard, or any equivalent structure which may be utilized to prevent loss or theft. Such an apparatus provides for utility by allowing users to both split open their smoking wrapper or sheath to replace the tobacco therein with another desired smoking substance, thus allowing a user to produce customized smoking devices of their own choosing.

What is claimed is:

1. An improved size adaptable cigar splitting apparatus, comprising:

an outer body;

a size adapting sleeve; and a blade carrier;

wherein said outer body comprises an opening passing there through which is adapted to receive a smoking device passing lengthwise through said opening in a sliding engagement, wherein said opening has an interior surface; and wherein said outer body further comprises a channel adapted to slidingly receive said blade carrier, and wherein said blade carrier comprises a blade having a cutting edge, said cutting edge of said blade protruding into said opening of said outer body when said blade carrier is slidingly received by said channel, wherein said cutting edge of said blade is oriented so as to slice a wrapper of a smoking device passing through said opening of said outer body; and wherein said inner surface of said opening is further adapted to slidingly receive a size adapting sleeve; and wherein said size adapting sleeve has an outer surface, and wherein said size adapting sleeve outer surface is adapted to be slidingly engaged with said interior surface of said channel; and wherein said size adapting sleeve further comprises a receiving orifice passing lengthwise through said size adapting sleeve, said receiving orifice adapted to receive a smoking device passing lengthwise through said receiving orifice in a sliding engagement; and wherein said size adapting sleeve further comprises a slot adapted to allow passage of said blade through said size adapting sleeve as said size adapting sleeve is slidingly engaged with said outer body interior surface; and wherein said blade is of sufficient dimension to protrude into said receiving orifice of said size adapting sleeve when said size adapting sleeve is slidingly engaged with said interior surface of said outer body.

2. An improved size adaptable cigar splitting apparatus of claim 1:

wherein said interior surface of said outer body opening and said adapting sleeve outer surface are substantially cylindrical in shape.

3. An improved size adaptable cigar splitting apparatus of claim 1:

wherein said interior surface of said outer body opening and said adapting sleeve outer surface are substantially rectilinear in cross section.

4. An improved size adaptable cigar splitting apparatus of claim 1:

further comprising a lanyard tang comprising a protrusion attached to said outer body, said protrusion having a through hole disposed there through.

5. An improved size adaptable cigar splitting apparatus of claim 2:

further comprising a lanyard tang comprising a protrusion attached to said outer body, said protrusion having a through hole disposed there through.

6. An improved size adaptable cigar splitting apparatus of claim 3:

further comprising a lanyard tang comprising a protrusion attached to said outer body, said protrusion having a through hole disposed there through.

7. An improved size adaptable cigar splitting apparatus of claim 1:

wherein said size adapting sleeve further comprises a flange disposed thereon, said flange having an outer face, and wherein said flange is disposed on a face of said size adapting sleeve orthogonal to said receiving orifice and extends beyond said outer surface of said size adapting sleeve;

and wherein said outer body further comprises a recess adapted to receive said flange such that when said size adapting sleeve is inserted into said outer body, said flange outer face is flush with an outer surface of said outer body.

8. An improved size adaptable cigar splitting apparatus of claim 2:

wherein said size adapting sleeve further comprises a flange disposed thereon, said flange having an outer face, and wherein said flange is disposed on a face of said size adapting sleeve orthogonal to said receiving orifice and extends beyond said outer surface of said size adapting sleeve;

and wherein said outer body further comprises a recess adapted to receive said flange such that when said size adapting sleeve is inserted into said outer body, said flange outer face is flush with an outer surface of said outer body.

9. An improved size adaptable cigar splitting apparatus of claim 3:

wherein said size adapting sleeve further comprises a flange disposed thereon, said flange having an outer face, and wherein said flange is disposed on a face of said size adapting sleeve orthogonal to said receiving orifice and extends beyond said outer surface of said size adapting sleeve;

and wherein said outer body further comprises a recess adapted to receive said flange such that when said size adapting sleeve is inserted into said outer body, said flange outer face is flush with an outer surface of said outer body.

10. An improved size adaptable cigar splitting apparatus of claim 4:

wherein said size adapting sleeve further comprises a flange disposed thereon, said flange having an outer face, and wherein said flange is disposed on a face of said size adapting sleeve orthogonal to said receiving orifice and extends beyond said outer surface of said size adapting sleeve;

and wherein said outer body further comprises a recess adapted to receive said flange such that when said size adapting sleeve is inserted into said outer body, said flange outer face is flush with an outer surface of said outer body.

11. An improved size adaptable cigar splitting apparatus of claim 5:

wherein said size adapting sleeve further comprises a flange disposed thereon, said flange having an outer face, and wherein said flange is disposed on a face of said size adapting sleeve orthogonal to said receiving orifice and extends beyond said outer surface of said size adapting sleeve;

and wherein said outer body further comprises a recess adapted to receive said flange such that when said size adapting sleeve is inserted into said outer body, said flange outer face is flush with an outer surface of said outer body.

12. An improved size adaptable cigar splitting apparatus of claim 6:

wherein said size adapting sleeve further comprises a flange disposed thereon, said flange having an outer face, and wherein said flange is disposed on a face of said size adapting sleeve orthogonal to said receiving orifice and extends beyond said outer surface of said size adapting sleeve;

and wherein said outer body further comprises a recess adapted to receive said flange such that when said size adapting sleeve is inserted into said outer body, said flange outer face is flush with an outer surface of said outer body.

13. An improved size adaptable cigar splitting apparatus of claim 1:

wherein said outer body and said size adapting sleeve are fabricated from a material selected from the group consisting of plastic, wood and phenolic.

14. An improved size adaptable cigar splitting apparatus of claim 2:

wherein said outer body and said size adapting sleeve are fabricated from a material selected from the group consisting of plastic, wood and phenolic.

15. An improved size adaptable cigar splitting apparatus of claim 3:

wherein said outer body and said size adapting sleeve are fabricated from a material selected from the group consisting of plastic, wood and phenolic.

16. An improved size adaptable cigar splitting apparatus of claim 8:

wherein said outer body and said size adapting sleeve are fabricated from a material selected from the group consisting of plastic, wood and phenolic.

17. An improved size adaptable cigar splitting apparatus of claim 10:

wherein said outer body and said size adapting sleeve are fabricated from a material selected from the group consisting of plastic, wood and phenolic.

* * * * *